US008086153B2

(12) United States Patent
Jeon et al.

(10) Patent No.: US 8,086,153 B2
(45) Date of Patent: Dec. 27, 2011

(54) DEVELOPING APPARATUS USABLE WITH IMAGE FORMING APPARATUS, IMAGE FORMING APPARATUS HAVING THE SAME, METHOD TO PREVENT DEVELOPER FROM FLOWING OUT THE DEVELOPING APPARATUS

(75) Inventors: In-cheol Jeon, Yongin-si (KR); Yong-baek Yoo, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 534 days.

(21) Appl. No.: 12/248,112

(22) Filed: Oct. 9, 2008

(65) Prior Publication Data

US 2009/0274489 A1 Nov. 5, 2009

(30) Foreign Application Priority Data

Apr. 30, 2008 (KR) ..... 10-2008-0040543
May 8, 2008 (KR) ..... 10-2008-0042920

(51) Int. Cl.
*G03G 15/08* (2006.01)
*G03G 15/09* (2006.01)

(52) U.S. Cl. ..... 399/282; 399/277; 399/229; 399/272

(58) Field of Classification Search ..... 399/29, 399/119, 222, 228, 229, 107, 169, 234, 252, 399/267, 272, 274, 276, 282, 284
See application file for complete search history.

(56) References Cited

U.S. PATENT DOCUMENTS

| | | | | |
|---|---|---|---|---|
| 4,330,198 | A * | 5/1982 | Matsumoto et al. | 399/234 |
| 6,208,817 | B1 * | 3/2001 | Chadani et al. | 399/104 |
| 2004/0022560 | A1 * | 2/2004 | Hirobe et al. | 399/269 |
| 2004/0126146 | A1 * | 7/2004 | Mashtare et al. | 399/272 |

FOREIGN PATENT DOCUMENTS

EP 0311020 * 4/1989

* cited by examiner

*Primary Examiner* — David Porta
*Assistant Examiner* — Yara Green
(74) *Attorney, Agent, or Firm* — Stanzione & Kim, LLP

(57) ABSTRACT

A developing apparatus usable with an image forming apparatus includes a developer carrier includes a plurality of magnetic poles and a case to rotatably support the developer carrier, the case storing developer is supplied to the developer carrier, and a magnetic pole changing apparatus disposed at an end of the developer carrier to change a position of the plurality of magnetic poles with respect to the case.

23 Claims, 7 Drawing Sheets

DEVELOPING APPARATUS USABLE WITH IMAGE FORMING APPARATUS, IMAGE FORMING APPARATUS HAVING THE SAME, METHOD TO PREVENT DEVELOPER FROM FLOWING OUT THE DEVELOPING APPARATUS

CROSS-REFERENCE TO RELATED APPLICATIONS

This application claims priority under 35 U.S.C. §119(a) from Korean Patent Applications No. 2008-40543 filed Apr. 30, 2008 and No. 2008-42920 filed May 7, 2008 in the Korean Intellectual Property Office, the disclosures of which are incorporated herein by reference in their entireties.

BACKGROUND OF THE INVENTION

1. Field of the Invention

The present general inventive concept relates to an image forming apparatus. More particularly, the present general inventive concept relates to a developing apparatus usable with an image forming apparatus using either two-component developer or magnetic developer, an image forming apparatus having the same, and a method to prevent developer from flowing out from the developing apparatus.

2. Description of the Related Art

Generally, developer, such as two-component developer, magnetic developer, etc., is used in electro photographic image forming apparatuses, such as printers, facsimile machines, copy machines, multifunctional products, or the like, to form images. Therefore, the image forming apparatus is provided with a developing apparatus to supply either two-component developer or magnetic developer to form images.

The developing apparatus using either two-component developer or magnetic developer is configured to form a magnetic brush on a surface of a developer carrier so that the developer is attached to the surface of the developer carrier by the magnetic brush, and to convey the developer to an image carrier so that electrostatic latent images formed on the image carrier are developed into developer images. Therefore, the developer always remains to be attached on the surface of the developer carrier.

When transporting the developing apparatuses using two-component developer or magnetic developer for sale, etc., vibration and/or impact is applied to the developing apparatus so that the developer attached on the surface of the developer carrier is separated from the developer carrier and flowed out from the developing apparatus. As the developer is flowed out, a quantity of the developer being stored therein is reduced and an area around the developing apparatus is contaminated by the developer.

Therefore, in order to prevent developer from flowing out during distribution thereof, the developing apparatuses using either two-component developer or magnetic developer are sold in a state that the developer is not filled up in the developing apparatus. After being sold, an installing mechanic visits a customer, which bought the developing apparatus using either two-component developer or magnetic developer, to fill up the developing apparatus with developer and to mount the developing apparatus in the image forming apparatus. As a result, there is a problem that the conventional developing apparatus using either two-component developer or magnetic developer is inconvenient to be transported and mounted.

SUMMARY OF THE INVENTION

The present general inventive concept provides a developing apparatus usable with an image forming apparatus to easily remove developer from a developer carrier and to prevent developer being stored therein from flowing out, an image forming apparatus having the same, and a method to prevent developer from flowing out from the developing apparatus.

Additional aspects and utilities of the present general inventive concept will be set forth in part in the description which follows and, in part, will be obvious from the description, or may be learned by practice of the general inventive concept.

The foregoing and/or other aspect and utilities of the present general inventive concept can substantially be achieved by providing a developing apparatus usable with an image forming apparatus, the developing apparatus includes a developer carrier including a plurality of magnetic poles, a case to rotatably support the developer carrier and to store developer being supplied to the developer carrier, and a magnetic pole changing apparatus disposed at an end of the developer carrier to change a position of the plurality of magnetic poles with respect to the case.

The developer carrier may include a developing sleeve rotatably disposed at the case, and a magnetic roller disposed inside the developing sleeve, the magnetic roller having the plurality of magnetic poles.

The magnetic pole changing apparatus may include a magnetic pole positioning member disposed at the case, the magnetic pole positioning member having a plurality of positioning portions, and a magnetic pole rotating member disposed at an end of a shaft of the magnetic roller to allow the magnetic roller to be fixed in any one of the plurality of positioning portions of the magnetic pole positioning member.

The plurality of positioning portions may include a developer supplying position in which the developer carrier can convey developer, and a developer supply blocking position in which the developer carrier cannot convey developer.

The magnetic pole rotating member may include a rotating plate disposed at the shaft of the magnetic roller, and at least one fixing projection disposed at the rotating plate.

The magnetic pole rotating member may include at least one elastic strip on which the at least one fixing projection is disposed.

The magnetic pole rotating member may include a handle.

The magnetic pole rotating member may include a lever perpendicularly disposed at an end of the shaft of the magnetic roller, and a fixing projection disposed at a leading end of the lever.

The magnetic pole changing apparatus may allow the magnetic roller to rotate only in one direction.

The magnetic pole positioning member may be formed in a ratchet.

The plurality of magnetic poles may include a developing pole, a conveying pole, a separating pole, and an attracting pole arranged in a circumference.

The developing apparatus may include a developer-regulating member to regulate a height of the developer attached on the developer carrier, wherein when the magnetic pole changing apparatus is set so that the attracting pole of the plurality of magnetic poles faces the developer-regulating member, the developer carrier can convey the developer.

When the magnetic pole changing apparatus is set so that the separating pole of the plurality of magnetic poles faces the developer-regulating member, the developer carrier cannot convey the developer.

The developing apparatus may include a developing sleeve driving member disposed at a first side of the case to drive the developing sleeve.

The magnetic pole changing apparatus may be disposed at a second sidewall of the case opposite to the first sidewall of the case at which the developing sleeve driving member is disposed.

The developing apparatus may include an image carrier rotatably disposed at the case parallel to the developer carrier.

The foregoing and/or other aspects and utilities of the present general inventive concept can also be achieved by providing an image forming apparatus, which include a printing medium feeding unit to feed a printing medium, an image carrier on which electrostatic latent images corresponding to printing data are formed, a developing apparatus to develop the electrostatic latent images formed on the image carrier into developer images, the developing apparatus including a developer carrier including a plurality of magnetic poles, a case to rotatably support the developer carrier and to store developer being supplied to the developer carrier, and a magnetic pole changing apparatus disposed at an end of the developer carrier to change a position of the plurality of magnetic poles with respect to the case, and a transferring roller to cause the developer images formed on the image carrier to be transferred onto the printing medium.

The foregoing and/or other aspects and utilities of the present general inventive concept can also be achieved by providing a method to prevent developer from flowing out from a developing apparatus that includes a developing sleeve and a magnetic roller disposed inside the developing sleeve and having a plurality of magnetic poles. The method may include rotating the magnetic roller in one direction, and fixing the magnetic roller in a developer supply blocking position in which the plurality of magnetic poles of the magnetic roller is arranged to prevent developer from being moved by the developing sleeve.

The method may include rotating the magnetic roller further in a same direction, and fixing the magnetic roller in a developer supplying position in which the plurality of magnetic poles of the magnetic roller is arranged for the developing sleeve to convey developer.

The magnetic roller may rotate in a same direction as a rotating direction of the developing sleeve.

The plurality of magnetic poles may include a developing pole, a conveying pole, a separating pole, and an attracting pole arranged in a circumference, wherein when the attracting pole faces the image carrier, the developer is not conveyed to the image carrier by the developing sleeve. When the developing pole also faces the image carrier, the developer is conveyed to the image carrier by the developing sleeve.

The foregoing and/or other aspects and utilities of the present general inventive concept can also be achieved by providing a developing apparatus usable with an image forming apparatus, the developer apparatus including a developer carrier, and a magnetic roller having a plurality of magnetic poles, and to rotate to arrange the plurality of magnetic poles in one of a developer supplying position in which the developer carrier conveys developer and a developer supply blocking position in which the developer carrier does not convey the developer.

In the developer supply blocking position the developer may be prevented from flowing out of the developing apparatus.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
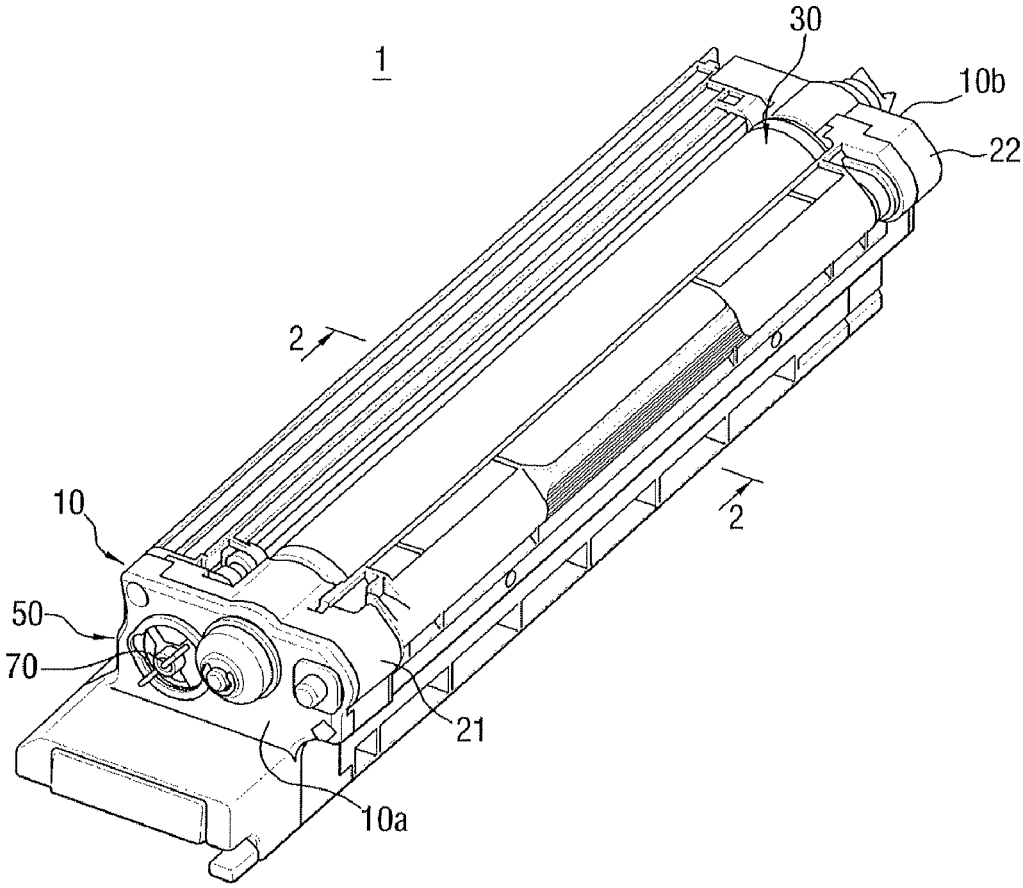
FIG. 1 is a perspective view illustrating a developing apparatus usable with an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present inventive concept may be carried out without those defined matters. Also, well-known functions or constructions are omitted to provide a clear and concise description of exemplary embodiments herein.

Figure 2:
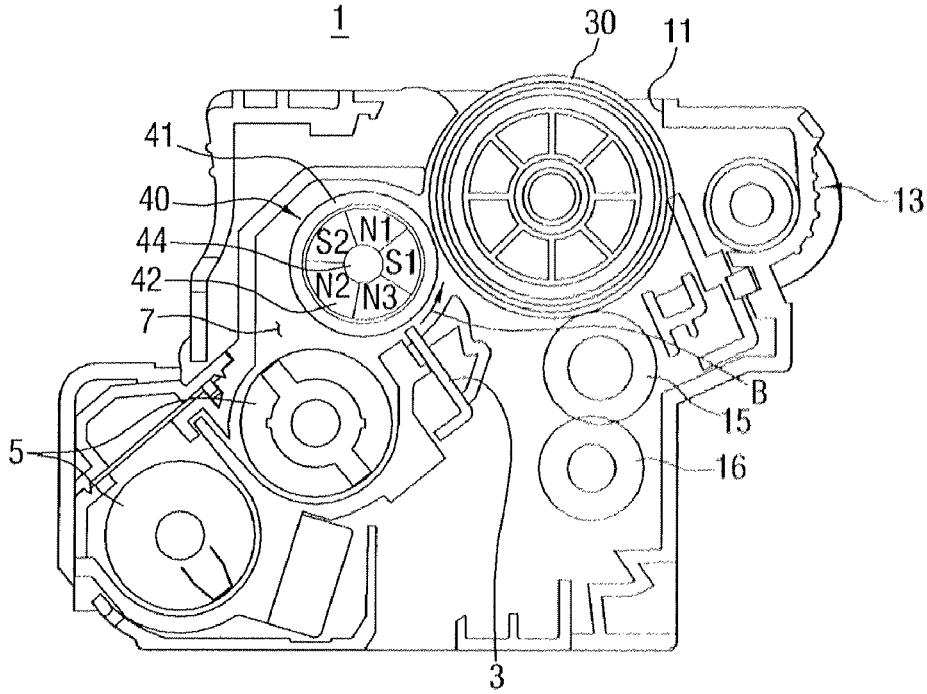
FIG. 2 is a sectional view illustrating the developing apparatus of FIG. 1 taken along a line 2-2 in FIG. 1.
Figure 3:
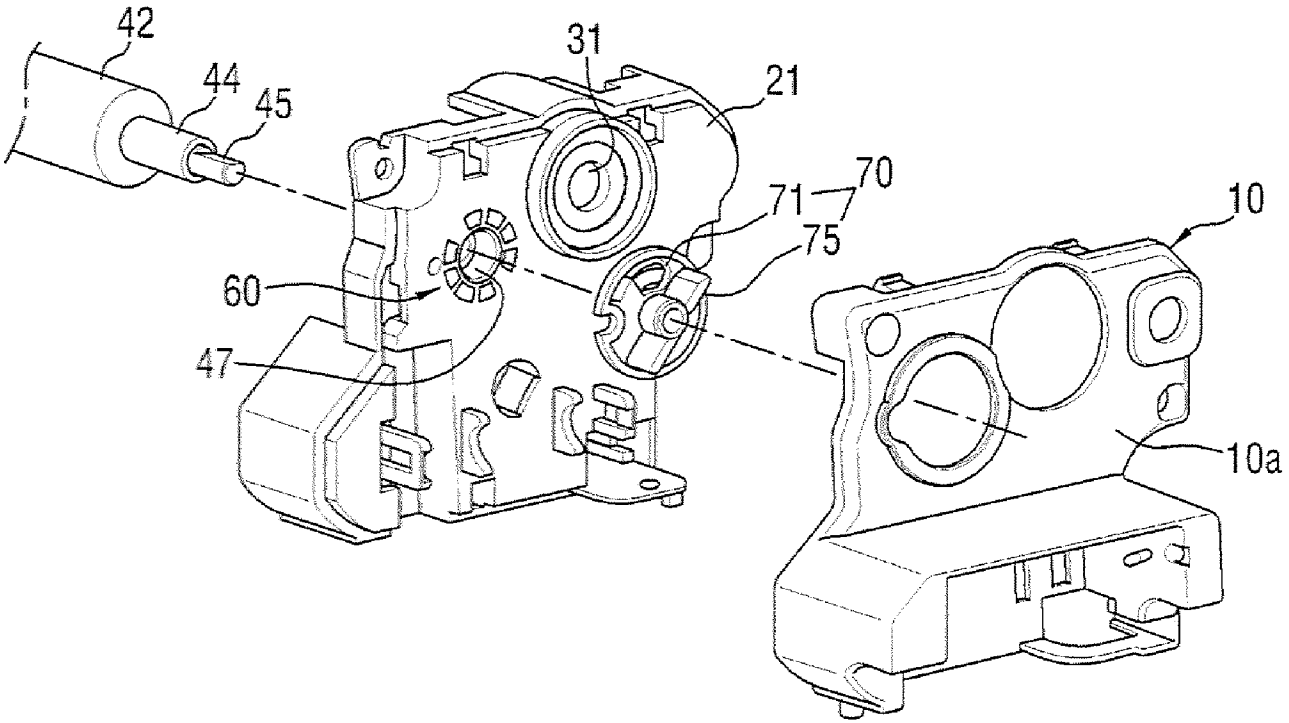
FIG. 3 is an exploded perspective view illustrating a magnetic pole changing apparatus being used in the developing apparatus usable with an image forming apparatus of FIG. 1.

FIG. 1 is a perspective view illustrating a developing apparatus 1 usable with an image forming apparatus according to an exemplary embodiment of the present general inventive concept. FIG. 2 is a sectional view illustrating the developing apparatus 1 of FIG. 1 taken along a line 2-2 in FIG. 1. FIG. 3 is an exploded perspective view illustrating a magnetic pole changing apparatus 50 being used in the developing apparatus 1 usable with an image forming apparatus of FIG. 1.

Referring to FIGS. 1 and 2, the developing apparatus 1 usable with an image forming apparatus according to an exemplary embodiment of the present general inventive concept may include a case 10, an image carrier 30, a developer carrier 40, and the magnetic pole changing apparatus 50.

The case 10 forms an external appearance of the developing apparatus 1 usable with an image forming apparatus, and may rotatably support therein the image carrier 30 and the developer carrier 40. At this time, opposite sidewalls of the case 10 may be configured to support the image carrier 30 and the developer carrier 40. Alternatively, left and right supporting members 21 and 22, which are separately formed to support rotations of each of the developer carrier 40 and the image carrier 30, may be disposed at opposite sides of the case 10. In this exemplary embodiment, as illustrated in FIG. 1, the left and right supporting members 21 and 22 separately formed are disposed at the opposite sides of the case 10. The left and right supporting members 21 and 22 are mounted on the corresponding sidewalls of the case 10 or are formed as a portion of the corresponding sidewalls of the case 10.

Figure 11:
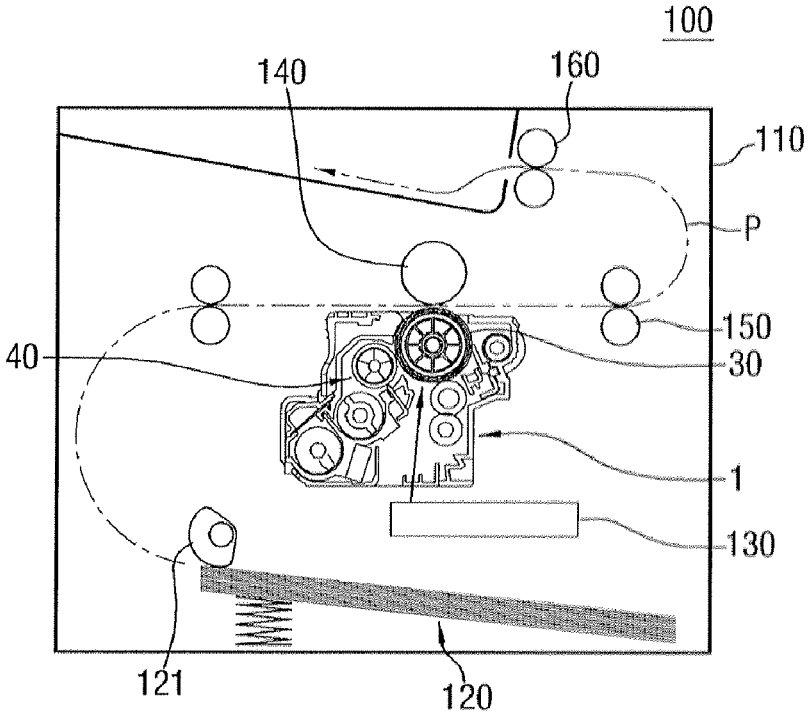
FIG. 11 is a sectional view illustrating an image forming apparatus using a developing apparatus according to an exemplary embodiment of the present general inventive concept.

The image carrier 30 may be rotatably disposed inside the case 10, and a portion of the image carrier 30 may be exposed to an outside of the case 10 through an opening 11 formed at a top surface of the case 10. The top surface of the case 10 is mounted between the sidewalls of the case or between the left and right supporting members 21 and 22 of the case 10. Therefore, when the developing apparatus 1 is mounted in the image forming apparatus 100 (FIG. 11), the image carrier 30, as illustrated in FIG. 11, faces a transferring roller 140 via the opening 11. In this exemplary embodiment, the image carrier 30 is provided as disposed integrally with the case 10. Alternatively, the image carrier 30 may be configured to be supported by a frame (not illustrated) formed separately from the case 10.

Referring to FIGS. 1-2 and 11, the developer carrier 40 is configured to supply developer from a developer-storing portion 7 formed inside the case 10 to the image carrier 30. In this exemplary embodiment, the developer carrier 40 includes a developing sleeve 41 and a magnetic roller 42. The developing sleeve 41 is formed substantially in a hollow cylindrical shape, and is rotatably supported by the left and right supporting members 21 and 22 disposed at the opposite sides of the case 10. The developing sleeve 41 is configured to receive directly or indirectly power from the image forming apparatus 100 (FIG. 11) via a developing sleeve driving member (not illustrated) provided at a side thereof and to rotate. The developing sleeve 41 may be configured in either a gear structure or a coupling structure. Also, a connecting portion (not illustrated) to connect the developing sleeve driving member and the developing sleeve 41 may be disposed at an end of the developing sleeve 41. The connecting portion may be configured to use any one of a D-cut connecting structure, a pin connecting structure, or a key connecting structure.

The magnetic roller 42 may be disposed to rotate independently from the developing sleeve 41, inside the developing sleeve 41, coaxially with the developing sleeve 41. The magnetic roller 42 may be provided with a plurality of magnetic poles (S1, N1, S2, N2, N3) arranged in a circumference thereof. That is, the magnetic roller 42 is configured to have the plurality of magnetic poles (S1, N1, S2, N2, N3) formed of permanent magnets. Referring to FIG. 2, the magnetic roller 42 is formed such that five permanent magnets (S1, N1, S2, N2, N3) are arranged in a circumference of a circle based on a shaft 44 of the magnetic roller 42 (hereinafter, refer to a magnetic roller shaft) so as to form a cylindrical shape. So the magnetic roller 42 includes five magnetic poles S1, N1, S2, N2, and N3. The five permanent magnets S1, N1, S2, N2, and N3 includes three N-poles N1, N2, and N3 and two S-poles S1 and S2, and form a magnetic brush on an outer circumferential surface of the developing sleeve 41 disposed to rotate outside of the magnetic roller 42 so that the developing sleeve 41 can convey developer to the image carrier 30. That is, the five magnets S1, N1, S2, N2, and N3 may function in order as a developing pole S1, a conveying pole N1 and S2, a separating pole N2, and an attracting pole N3.

The developing pole S1 faces the image carrier 30 across the developing sleeve 41, and causes the developer attached on the surface of the developing sleeve 41 to move to the image carrier 30. The attracting pole N3 causes the developer from the developer-storing portion 7 to be attached on the surface of the developing sleeve 41 and is disposed nearby the developing pole S1 upstream of the developing pole S1 in a rotating direction of the developing sleeve 41 (arrow B in FIG. 2). The conveying pole N1 and S2 allows some developer and the carrier of the developer, which are not transported to the image carrier 30 by the developing pole S1, to return toward the developer-storing portion 7 with being attached on the developing sleeve 41, and is disposed nearby the developing pole S1 downstream of the developing pole S1 in the rotating direction of the developing sleeve 41. The separating pole N2 allows the developer, which returns to the developer-storing portion 7 with being attached on the developing sleeve 41, to be separated apart from the developing sleeve 41, and is disposed nearby the conveying pole S2 downstream of the developing pole S1 in the rotating direction of the developing sleeve 41. Accordingly, the separating pole N2 and the attracting pole N3 are disposed nearby each other. However, since the separating pole N2 and the attracting pole N3 are magnetic poles having the same magnetic polarity, no developer is attached on a portion of the developing sleeve 41 corresponding to a portion between the separating pole N2 and the attracting pole N3.

In the above explanation, the magnetic roller 42 has a magnetic poles arrangement in which the developing pole is S1 pole, the conveying pole is N1 and S2 poles, the separating pole is N2 pole, and the attracting pole is N3 pole. However, this does not limit the magnetic poles arrangement of the magnetic roller 42. Alternatively, the magnetic roller 42 may have another magnetic poles arrangement in which the developing pole is N1 pole, the conveying pole is S1 and N2 poles, the separating pole is S2 pole, and the attracting pole is S3 pole. Also, although the magnetic roller 42 has five magnetic poles in the above description, however this does not limit a number of the magnetic poles to form the magnetic roller 42.

As illustrated in FIG. 2, the developer-storing portion 7 is formed inside the case 10 to store developer. The developer is two-component developer composing of carrier having a property being attracted by a magnet and toner developing electrostatic latent images. Alternatively, toner having a property being attracted by a magnet can be used as the developer. Two developer-agitating members 5 may be rotatably disposed at the developer-storing portion 7 below the developer carrier 40. The two developer-agitating members 5 mix the stored developer, and supply the stored developer to the developer carrier 40. A developer-regulating member 3 may be disposed at a side of the developer carrier 40 so as to regulate uniformly a height of the developer attached on the developing sleeve 41.

A developer carrier cleaning unit 13 to remove waste toner remaining on the image carrier 30 and a charging roller 15 to charge the surface of the image carrier 30 may be disposed at a side of the image carrier 30. A cleaning roller 16 to clean the charging roller 15 may be disposed below the charging roller 15.

The magnetic pole changing apparatus 50 allows the magnetic pole position of the magnetic roller 42, that is, angles or arrangement of the plurality of magnetic poles S1, N1, S2, N2, and N3 forming the magnetic roller 42 with respect to either the image carrier 30 or the case 10 to be changed, and is configured to rotate the magnetic roller 42. The magnetic pole changing apparatus 50 may include a magnetic pole positioning member 60 (FIG. 3) and a magnetic pole rotating member 70.

The magnetic pole positioning member 60 is disposed at a second sidewall opposite to a first sidewall of the case 10 at which the developing sleeve driving member is disposed. If the developing sleeve driving member and the magnetic pole positioning member 50 are disposed at the same sidewall of the case 10, the developing sleeve driving member and the magnetic pole positioning member 50 are overlapped and/or interfered with each other so that defining a proper relationship therebetween is difficult and the developing sleeve driving member and the magnetic pole positioning member 50 have a complex structure. Also, rotating the magnetic pole positioning member 60 to a proper position may be inconvenient.

Figure 4:
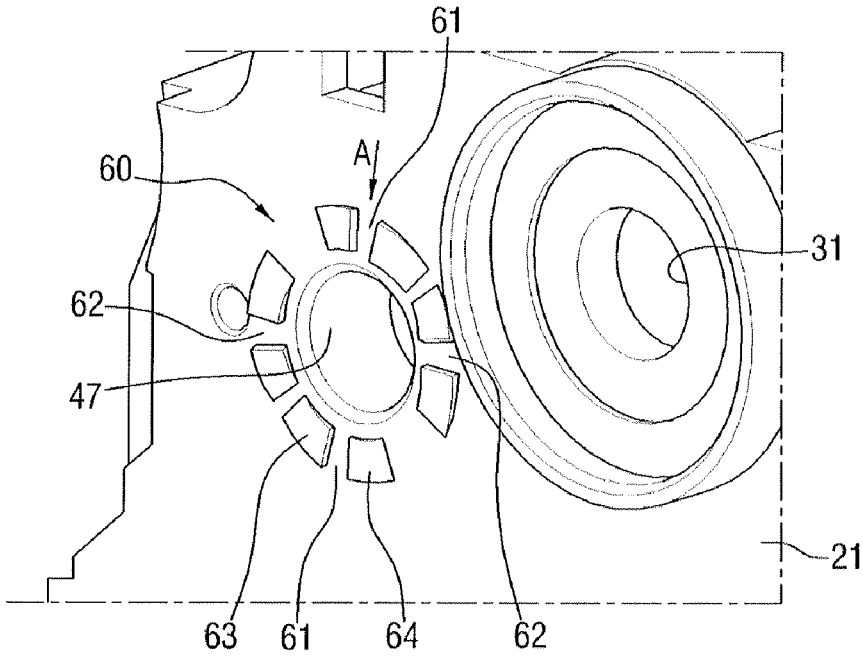
FIG. 4 is a partial perspective view illustrating a magnetic pole positioning member of the magnetic pole changing apparatus of FIG. 3.

The magnetic pole positioning member 60 may have a plurality of positioning portions 61 and 62 formed around a magnetic roller shaft hole 47 to support the magnetic roller shaft 44 to rotate. The plurality of positioning portions 61 and 62 is configured to allow the plurality of magnetic poles S1, N1, S2, N2, and N3 of the magnetic roller 42 to keep a specific positioning relationship with respect to the image carrier 30 together with the magnetic pole rotating member 70. FIGS. 3 and 4 illustrate an example of the magnetic pole positioning member 60. Referring to FIGS. 3 and 4, in this exemplary embodiment, the magnetic pole positioning member 60 is formed on an outside surface of the left supporting member 21 to support the magnetic roller shaft 44. Also, an image carrier shaft hole 31 to support an image carrier shaft (not illustrated) is formed at the left supporting member 21 at a side of the magnetic roller shaft hole 47.

Figure 7:
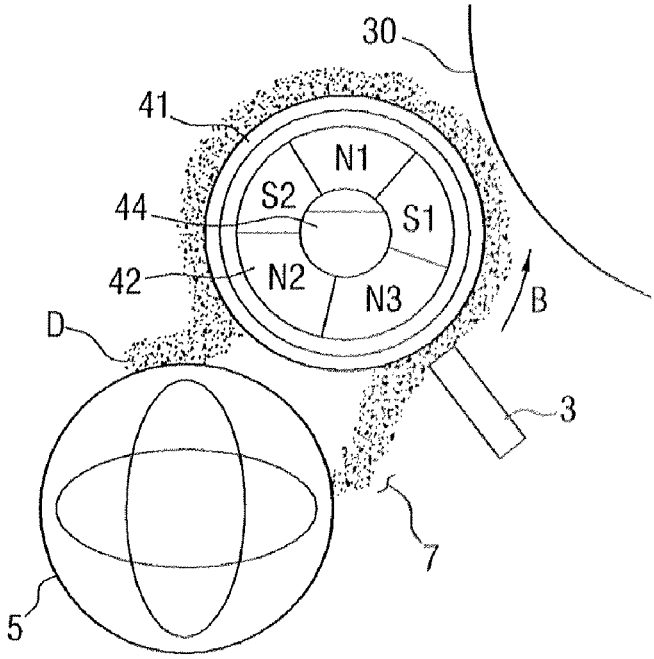
FIG. 7 is a partial sectional view illustrating a developer carrier of the developing apparatus usable with an image forming apparatus of FIG. 1 supplying developer to an image carrier.
Figure 8:
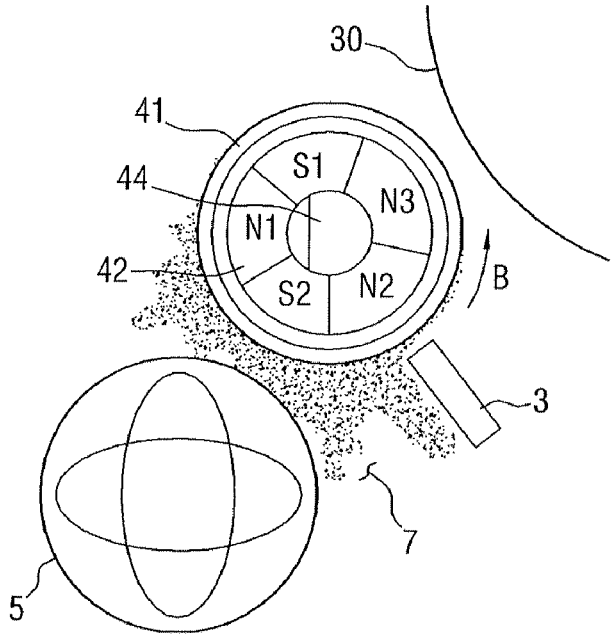
FIG. 8 is a partial sectional view illustrating a developer carrier of the developing apparatus usable with an image forming apparatus of FIG. 1 not supplying developer to an image carrier.

The magnetic pole positioning member 60 may include four positioning portions 61 and 62. Two first positioning portions 61 being spaced apart by approximate 180 degrees from each other allows the magnetic roller 42 to be fixed at a developer supplying position in which the plurality of magnetic poles S1, N1, S2, N2, and N3 of the magnetic roller 42 is arranged as illustrated in FIG. 7, so the developer carrier 40 supplies the image carrier 30 with the developer. Two second positioning portions 62 being spaced apart by approximate 180 degrees from each other also allows the magnetic roller 42 to be fixed at a developer supply blocking position in which the plurality of magnetic poles S1, N1, S2, N2, and N3 of the magnetic roller 42 is arranged as illustrated in FIG. 8, so that the developer is removed from the developing sleeve 41 of the developer carrier 40, and even when the developing sleeve 41 rotates, no developer moves from the developer-storing portion 7 toward the image carrier 30 along the developing sleeve 41. Each of the plurality of positioning portions 61 and 62 may be formed in a groove in which a fixing projection 73 of the magnetic pole rotating member 70 described below is fixed.

When the magnetic roller 42 is disposed at the developer supplying position, as illustrated in FIG. 7, the developing pole S1 of the magnetic roller 42 faces the image carrier 30 across the developing sleeve 41. Alternatively, when the magnetic roller 42 is disposed at the developer supply blocking position, as illustrated in FIG. 8, the attracting pole N3 of the magnetic roller 42 faces the image carrier 30.

Figure 6:
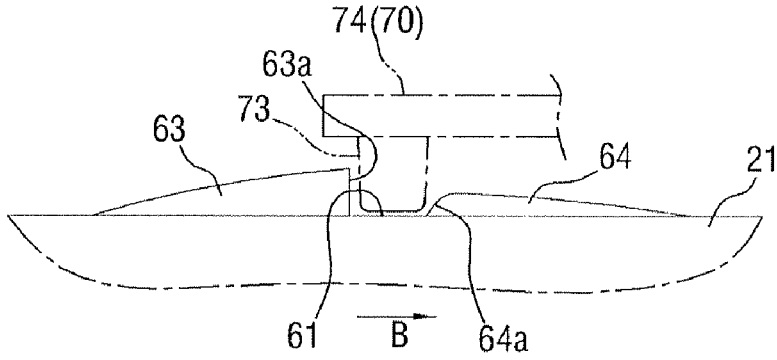
FIG. 6 is a partial side view illustrating a magnetic pole rotating member of the magnetic pole changing apparatus of FIG. 3 being viewed in a direction of arrow A in FIG. 3.

Also, the magnetic pole positioning member 60, as illustrated in FIG. 6, may be configured in a ratchet shape to allow the magnetic pole rotating member 70 to rotate only in one direction. That is, an entering slope 63 being inclined upward in the rotating direction of the developing sleeve 41 may be formed at a first side of the positioning portion 61 and 62 (the left side of the first positioning portion 61 in FIG. 6), and an exiting slope 64 being downward in the rotating direction of the developing sleeve 41 is formed at a second side of the positioning portion 61 and 62 (the right side of the first positioning portion 61 in FIG. 6). Accordingly, the positioning portion 61 and 62 between the entering slope 63 and the exiting slope 64 is formed substantially in a groove shape so that the positioning portion 61 and 62 receives the fixing projection 73 of the magnetic pole rotating member 70 to prevent rotation of the magnetic pole rotating member 70. Also, a side surface 64*a* of the exiting slope 64 adjacent to the positioning portion 61 and 62 has the maximum height lower than that of the entering slope 63 and is formed in a curved surface so that when the magnetic pole rotating member 70 receives a certain magnitude of force, the fixing projection 73 of the magnetic pole rotating member 70 can climb over the side surface 64*a* of the exiting slope 64. Therefore, when a user rotates the magnetic pole rotating member 70 in the rotating direction of the developing sleeve 41, the fixing projection 73 of the magnetic pole rotating member 70 gets out of the positioning portion 61 and 62 so that the magnetic roller 42 rotates in the same direction as that of the developing sleeve 41. However, when rotating the magnetic pole rotating member 70 in the opposite direction to the rotating direction of the developing sleeve 41, the fixing projection 73 of the magnetic pole rotating member 70 is blocked against a vertical surface 63*a* of the entering slope 63 so that the magnetic pole rotating member 70 cannot rotate in the opposite direction to the rotating direction of the developing sleeve 41.

Although the magnetic pole positioning member 60 being formed at the left supporting member 21 is described above, however, this does not limit a position in which the magnetic pole positioning member 60 can be disposed. If the case 10 is formed to support the developer carrier 40 using opposite sidewalls 10*a* and 10*b* thereof without using the left and right supporting members 21 and 22, the magnetic pole positioning member 60 may be formed at the left sidewall 10*a* of the case 10.

The magnetic pole rotating member 70 is disposed at an end of the magnetic roller shaft 44, and is configured so that the magnetic pole rotating member 70 can allow to be rotated by the user and the magnetic roller 42 to be fixed in any one of the plurality of positioning portions 61 and 62 of the magnetic pole positioning member 60.

Figure 5:
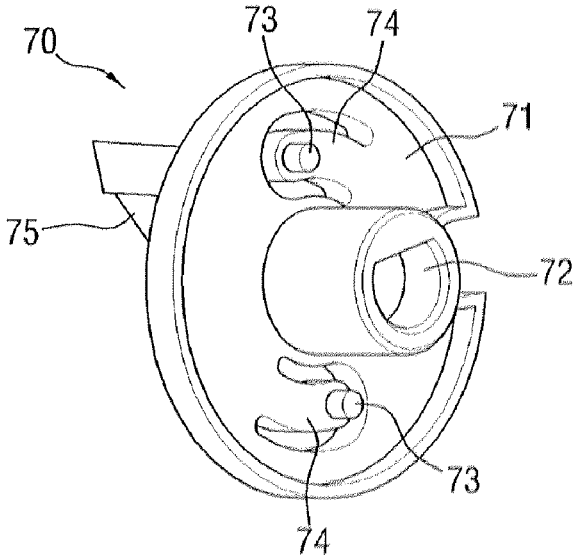
FIG. 5 is a rear perspective view illustrating a magnetic pole rotating member of the magnetic pole changing apparatus of FIG. 3.

In this exemplary embodiment, as illustrated in FIGS. 3 and 5, the magnetic pole rotating member 70 is formed substantially in a circular plate, and includes a rotating plate 71 being disposed at the magnetic roller shaft 44. The rotating plate 71 is disposed at the magnetic roller shaft 44 to rotate integrally with the magnetic roller shaft 44. In this exemplary embodiment, the one end 45 of the magnetic roller shaft 44 has a section being formed in a shape of the letter "D", and the rotating plate 71 has a coupling groove 72 corresponding to the letter "D" section of the magnetic roller shaft 44 and being formed in a center thereof. Therefore, when the magnetic pole rotating member 70 is disposed at the magnetic roller shaft 44, the magnetic pole rotating member 70 rotates integrally with the magnetic roller 42.

Furthermore, a plurality of fixing projections 73 is formed around the coupling groove 72 on a bottom surface of the rotating plate 71. The fixing projections 73 may be supported by elastic strips 74 as illustrated in FIG. 5 to climb over the entering slope 63 and the exiting slope 64 of the magnetic pole positioning member 60. In this exemplary embodiment, the magnetic pole rotating member 70 has two fixing projections 73 being spaced by approximate 180 degrees from each other. The two fixing projections 73 are supported by the elastic strips 74 that are formed to cut portions of the rotating plate 71. Accordingly, the two fixing projections 73 are inserted and fixed in the first and second positioning portions 61 and 62 of the magnetic pole positioning member 60 that are formed in the two grooves being spaced apart by approximate 180 degrees from each other.

A handle 75 may be disposed on a top surface of the rotating plate 71 to grab and rotate the magnetic pole rotating member 70. At this time, the handle 75 may be formed substantially in an arrow shape with a sharp end, and the case 10 may be provided with marks presenting the developer supplying position and the developer supply blocking position on an outer surface thereof. If the handle 75 is formed substantially in an arrow shape, the user can easily identify a state in which the magnetic poles angle or the magnetic poles arrangement of the magnetic roller 42 being disposed inside the case 10 is in, that is, which the magnetic roller 42 is disposed at the developer supplying position or at the developer supply blocking position.

Hereinafter, operation of the developing apparatus 1 usable with an image forming apparatus according to an exemplary embodiment of the present general inventive concept having the structure as described above with reference to FIGS. 1 to 3 is illustrated.

First, the case will be explained when the magnetic roller 42 of the developer carrier 40 is disposed at the developer supplying position. When the magnetic roller 42 is disposed at the developer supplying position, the plurality of magnetic poles S1, N1, S2, N2, and N3 of the magnetic roller 42 is arranged so that the developing pole S1, as illustrated in FIGS. 2 and 7, faces the image carrier 30 across the developing sleeve 41. At this time, the two fixing projections 73 of the magnetic pole rotating member 70 are inserted in the two grooves forming the first positioning portion 61 of the magnetic pole positioning member 60. Therefore, even when the developing sleeve 41 rotates, the magnetic roller 42 does not rotate and remains in a stationary state.

When the developing sleeve 41 rotates in this state, developer moves from the developer-storing portion 7 to the image carrier 30, thereby developing the electrostatic latent images formed on the image carrier 30 into developer images.

Hereinafter, a process in which the developer carrier 40 conveys developer to the image carrier 30 will be explained in detail with reference to FIG. 7.

Developer in the developer-storing portion 7 is moved to and attached on the surface of the developing sleeve 41 by the magnetic force of the attracting pole N3 of the magnetic roller 42. When the developing sleeve 41 rotates, the developer attached on the developing sleeve 41 passes through the developer-regulating member 3, thereby being regulated in a predetermined height. Then the developer moves above the developing pole S1 to face the image carrier 30. Toner of the developer on the developing sleeve 41 being moved above the developing pole S1 moves to the image carrier 30, and carrier of the developer is still attached on the developing sleeve 41. When the developing sleeve 41 continues to rotate, some toner that is not moved to the image carrier 30 and carrier of the developer pass over the conveying pole N1 and S2 of the magnetic roller 42 and move above the separating pole N2 while being attached on the developing sleeve 41. The developer on the developing sleeve 41 that is moved above the separating pole N2 is separated apart from the surface of the developing sleeve 41 by the magnetic brush formed by the separating pole N2, and falls into the developer-storing portion 7. The dropped developer is mixed with the developer being stored in the developer-storing portion 7 by the developer-agitating members 5. The developer being stored in the developer-storing portion 7 is again attracted onto the developing sleeve 41 by the attracting pole N3 of the magnetic roller 42 and repeats the process as described above. Therefore, in the developing apparatus 1 usable with an image forming apparatus according to an exemplary embodiment of the present general inventive concept, when the magnetic roller 42 of the developer carrier 40 is disposed at the developer supplying position, the developing sleeve 41 of the developer carrier 40 supplies developer to normally develop electrostatic latent images formed on the image carrier 30.

Hereinafter, a process of changing the angle or the arrangement of the plurality of magnetic poles S1, N1, S2, N2, and N3 of the magnetic roller 42 of the developer carrier 40, that is, the magnetic pole position of the magnetic roller 42 to transport the developing apparatus 1 usable with an image forming apparatus according to an exemplary embodiment of the present general inventive concept will be explained in detail with reference to FIG. 8.

In a process of manufacturing the developing apparatus 1 usable with an image forming apparatus, checking images may be printed to check a quality of the developing apparatus 1. After the checking images are printed, developer is attached on the developer carrier 40 as illustrated in FIG. 7. Also, although no checking image is printed, developer being held in the case 10 may be attracted onto the developing sleeve 41 by the magnetic roller 42. Furthermore, while transporting the developing apparatus 1, the developing sleeve 41 may be rotated by a certain amount of degrees due to vibration and/or shake. At this time, an area of the surface of the developing sleeve 41 on which the developer is attached may be widened. Therefore, removing the developer attached on the surface of the developing sleeve 41 is required. For this, when the user or a worker manufacturing the developing apparatus 1 rotates the magnetic pole rotating member 70 of the magnetic pole changing apparatus 50 over one turn, the developer attached on the developing sleeve 41 of the developer carrier 40 is withdrawn into the developer-storing portion 7 inside the case 10. Here, rotating the magnetic pole rotating member 70 more than one turn is required. If the magnetic pole rotating member 70 is rotated less than one turn, the developer may remain on the surface of the developing sleeve 41 resulting in leaking.

That is, when the user or the worker in the process of manufacturing the developing apparatus 1 grabs and rotates the handle 75 of the magnetic pole rotating member 70 of the magnetic pole changing apparatus 50 in the rotating direction of the developing sleeve 41, the fixing projection 73 formed on a bottom surface of the magnetic pole rotating member 60 passes over the exiting slope 64, thereby passing by the first positioning portions 61. When the magnetic pole rotating member 70 continues to be rotated, the fixing projection 73 passing by the first positioning portions 61 enters the second positioning portions 62 along the entering slope 63 being formed adjacent the second positioning portions 62, thereby being fixed therein. When the fixing projection 73 of the magnetic pole rotating member 70 is disposed at the second positioning portions 62, the magnetic roller 42 is rotated together with the magnetic pole rotating member 70 so that the plurality of magnetic poles S1, N1, S2, N2, and N3 of the magnetic roller 42 is arranged as illustrated in FIG. 8.

When the plurality of magnetic poles S1, N1, S2, N2, and N3 of the magnetic roller 42 is arranged as illustrated in FIG. 8, the attracting pole N3 of the magnetic roller 42 is moved over the developer-regulating member 3 to face the image carrier 30, and the separating pole N2 faces the developer-regulating member 3. In this state, when the developing sleeve 41 rotates, the developer remains attached on the developing sleeve 41 during passing above the developing pole S1 and the conveying pole N1 and S2. When the developing sleeve 41 continues to rotate so that the developer attached on the developing sleeve 41 is disposed above the separating pole N2, the developer is separated apart from the developing sleeve 41, thereby falling into the developer-storing portion 7. In this state, because the attracting pole N3 of the magnetic roller 42 does not face the developer-storing portion 7, even when the developing sleeve 41 rotates, the developer is not attracted onto the developing sleeve 41 and is not moved toward the image carrier 30.

Alternatively, the developer can be attracted onto the developing sleeve 41 by the conveying pole N1 and S2 facing the developer-storing portion 7. However, when the developing sleeve 41 rotates, the developer attached on the developing sleeve 41 is separated apart from the developing sleeve 41 by the separating pole N2 to face the developer-regulating member 3. Therefore, when the magnetic roller 42 is disposed at the developer supply blocking position, developer does not escape from the developer-storing portion 7 and does not move to the image carrier 30.

For allowing the developing apparatus 1 to return to a normal state in which a printing operation can be performed, the magnetic pole rotating member 70 of the magnetic pole changing apparatus 50 is rotated so that the plurality of magnetic poles S1, N1, S2, N2, and N3 of the magnetic roller 42 is arranged in the developer supplying position as illustrated in FIG. 7. In the state that the magnetic roller 42 is disposed at the developer supplying position, as the developing sleeve 41 rotates one turn, developer is attached on and is moved with the developing sleeve 41 so that a normal printing operation can be performed.

Figure 9:
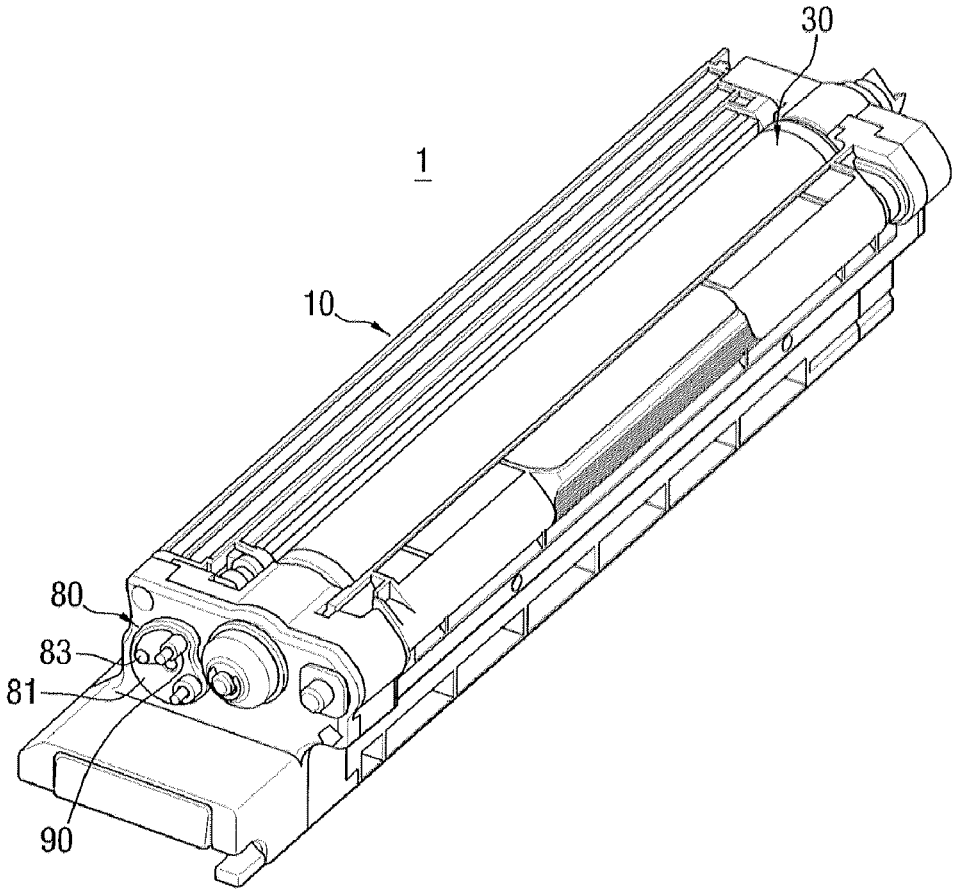
FIG. 9 is a perspective view illustrating a developing apparatus usable with an image forming apparatus according to another embodiment of the present general inventive concept.
Figure 10:
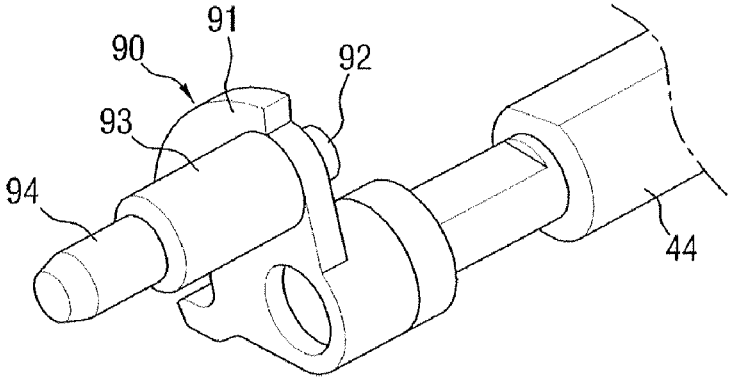
FIG. 10 is a partial perspective view illustrating a magnetic pole rotating member of the magnetic pole changing apparatus being used in the developing apparatus of FIG. 9.

FIGS. 9 and 10 illustrate a magnetic pole changing apparatus 80 that can be used in the developing apparatus 1 usable with an image forming apparatus according to another exemplary embodiment of the present general inventive concept.

Referring to FIGS. 9 and 10, the magnetic pole changing apparatus 80 of the developing apparatus 1 usable with an image forming apparatus according to another exemplary embodiment may include a magnetic pole positioning member 81 and a magnetic pole rotating member 90.

The magnetic pole positioning member 81 may include a plurality of positioning portions 83 that is formed around the magnetic roller shaft hole rotatably supporting the magnetic roller shaft 44 on a sidewall of the case 10. The plurality of positioning portions 83 causes the magnetic roller 42 (FIG. 8) to be fixed in a predetermined position together with the magnetic pole rotating member 90 so that the plurality of magnetic poles S1, N1, S2, N2, and N3 of the magnetic roller 42 maintains a predetermined position relationship with respect to the image carrier 30. In this exemplary embodiment, two positioning portions 83 are formed by approximate 90 degrees interval. The first positioning portion (not illustrated) allows the plurality of magnetic poles S1, N1, S2, N2, and N3 of the magnetic roller 42 to locate at the developer supplying position. The second positioning portion 83 allows the plurality of magnetic poles S1, N1, S2, N2, and N3 of the magnetic roller 42 to locate at the developer supply blocking position. The first and second positioning portions 83 may be formed in a groove shape to receive a fixing projection 92 of the magnetic pole rotating member 90.

The magnetic pole rotating member 90 may include a lever 91 being disposed at an end of the magnetic roller shaft 44 perpendicularly to the magnetic roller shaft 44, and the fixing projection 92 formed at a leading end of the lever 91. A grip 93 to allow the lever 91 to rotate may be disposed on an outer surface of the lever 91 corresponding to the fixing projection 92. The grip 93 may include an elastic member (not illustrated) that is disposed inside the grip 93 to elastically support the fixing projection 92 and a pulling portion 94 that projects from the top end of the grip 93 and moves integrally with the fixing projection 92. Then, the elastic member allows the fixing projection 92 to be inserted in any one of the grooves of the first and second positioning portions 83. Accordingly, when the fixing projection 92 is inserted in any one of the first and second positioning portions 83, the magnetic pole rotating member 90 does not rotate. For rotating the magnetic pole rotating member 90, the pulling portion 94 projecting from the top end of the grip 93 is pulled so that the fixing projection 92 is disengaged from any one of the first and second positioning portions 83, and then, the grip 93 is rotated so that the magnetic pole rotating member 90 rotates.

FIG. 9 illustrates the magnetic pole changing apparatus 80 when the magnetic roller 42 is disposed at the developer supplying position. For changing the magnetic poles angle or the magnetic poles arrangement of the magnetic roller 42, that is, the magnetic pole position of the magnetic roller 42 from this state to the developer supply blocking position the magnetic pole rotating member 90 of the magnetic pole changing apparatus 80 is rotated so that the fixing projection 92 of the magnetic pole rotating member 90 is disposed at the second positioning portion 83. That is, the pulling portion 94 projecting from the top end of the grip 93 of the magnetic pole rotating member 90 that is disposed at the first positioning portion (not illustrated) is pulled to allow the fixing projection 92 to disengage from the first positioning portion. After that, when rotating the magnetic pole rotating member 90 using the grip 93, the fixing projection 92 is inserted into and is fixed in the second positioning portion 83. Then, the plurality of magnetic poles S1, N1, S2, N2, and N3 of the magnetic roller 42 is disposed at the developer supply blocking position.

In the developing apparatus 1 according to this exemplary embodiment, when the plurality of magnetic poles S1, N1, S2, N2, and N3 of the magnetic roller 42 is disposed at either the developer supplying position or the developer supply blocking position, the process in which the developer moves is substantially the same as that of the developing apparatus 1 according to the above-described exemplary embodiment. Therefore, detailed explanation thereof is not repeated.

In the magnetic pole changing apparatus 50 as described above, when the user rotates the magnetic pole rotating member 70 by a predetermined angle, the fixing projection 73 is automatically inserted into and is fixed in the positioning portions 61 and 62 of the magnetic pole positioning member 60. However, this does not limit the magnetic pole changing apparatus 50 of the developing apparatus 1 usable with an image forming apparatus according to an exemplary embodiment of the present general inventive concept. Alternatively, although not illustrated, the magnetic pole rotating member 70 may be secured on the sidewall of the case 10 using screws. That is, the magnetic pole rotating member 70 may be formed in a lever perpendicular to the magnetic roller shaft 44, and the lever may be provided with a hole being formed at an end thereof. The sidewall of the case 10 may be provided with two screw holes at two positions that allow the plurality of magnetic poles S1, N1, S2, N2, and N3 of the magnetic roller 42 to be disposed at the developer supplying position and the developer supply blocking position. Then, as the lever is rotated, the magnetic roller 42 is also rotated. After the hole of the lever is aligned with one screw hole of the case 10, the lever is secured to the case 10 by a screw so that the plurality of magnetic poles S1, N1, S2, N2, and N3 of the magnetic roller 42 is disposed at a specific arrangement position. After that, for changing the arrangement of the plurality of magnetic poles S1, N1, S2, N2, and N3 of the magnetic roller 42 the user removes the screw, rotates the magnetic roller 42 using the lever, and secures the lever to the other screw hole so that the magnetic roller 42 is fixed to the other arrangement position.

Also, in the above explanation, the magnetic pole rotating member 70 of the magnetic pole changing apparatus 50 is manually rotated by a user's hand; however, this does not limit the method of rotating the magnetic pole rotating member 70. Various apparatuses, such as a jig, an inspecting apparatus, etc. being configured to allow the magnetic pole rotating member 70 to rotate, can be used to rotate the magnetic pole rotating member 70.

The magnetic pole changing apparatus 50 of the developing apparatus 1 usable with an image forming apparatus according to the present general inventive concept may be configured to have various structures as long as the magnetic pole changing apparatus 50 can allow the magnetic roller 42 to be rotated and fixed.

Hereinafter, an image forming apparatus 100 using the developing apparatus 1 according to an exemplary embodiment of the present general inventive concept will be explained with reference to FIG. 11.

FIG. 11 is a sectional view schematically illustrating the image forming apparatus 100 using the developing apparatus 1 (FIG. 1) according to an exemplary embodiment of the present general inventive concept.

Referring to FIG. 11, the image forming apparatus 100 according to an exemplary embodiment of the present general inventive concept may include a main case 110, a printing medium feeding unit 120, an exposure unit 130, the developing apparatus 1, a transferring roller 140, a fixing unit 150, and a discharging unit 160.

The main case 110 forms an external appearance of the image forming apparatus 100, and supports the printing medium feeding unit 120, the exposure unit 130, the developing apparatus 1, the transferring roller 140, the fixing unit 150, and the discharging unit 160.

The printing medium feeding unit 120 stores predetermined sheets of printing media P, and picks up the printing media P one by one to feed the printing medium P to the developing apparatus 1. A pickup roller 121 may be disposed at a leading end of the printing medium feeding unit 120.

The exposure unit 130 emits a laser beam corresponding to print data to form electrostatic latent images on the image carrier 30 of the developing apparatus 1.

The developing apparatus 1 (FIG. 1) stores a predetermined quantity of developer, and develops the electrostatic latent images formed on the image carrier 30 into developer images. The developing apparatus 1 is detachably disposed in the main case 110. When the developing apparatus 1 is disposed in the main case 110, a power is transmitted from a driving apparatus (not illustrated) disposed inside the main case 110 so that the image carrier 30, the developer carrier 40, and the two developer-agitating members 5 rotate. The structure and operation of the developing apparatus 1 are described above; therefore, a detailed description thereof will not be repeated.

The transferring roller 140 causes the developer images formed on the image carrier 30 of the developing apparatus 1 to be transferred onto the printing medium P.

While passing through the fixing unit 150, the developer images transferred onto the printing medium P are fixed onto the printing medium P.

The discharging unit 160 discharges the printing medium P having the developer images fixed thereon outside the image forming apparatus 100.

Accordingly, when receiving a printing order, the image forming apparatus 100 controls the exposure unit 130 to emit a laser beam corresponding to printing data and form electrostatic latent images corresponding to the printing data on the image carrier 30 of the developing apparatus 1. Then, the developer carrier 40 of the developing apparatus 1 supplies developer to the image carrier 30, thereby developing the electrostatic latent images into developer images. In the developing apparatus 1 according to an exemplary embodiment of the present general inventive concept, the magnetic roller 42 of the developer carrier 40 is disposed at the developer supplying position so that developer is normally supplied to the image carrier 30.

The image forming apparatus 100 also controls the printing medium feeding unit 120 to pick up and feed a printing medium P between the transferring roller 140 and the image carrier 30. Then, the developer images are transferred from the image carrier 30 to the printing medium P.

The printing medium P having the developer images transferred thereon passes through the fixing unit 150 and the discharging unit 160, thereby being discharged outside the image forming apparatus 100.

For conveying the developing apparatus 1, the user or the worker operates the magnetic pole changing apparatus 50 so that the plurality of magnetic poles S1, N1, S2, N2, and N3 of the magnetic roller 42 is disposed at the developer supply blocking position. That is, the magnetic pole rotating member 70 of the magnetic pole changing apparatus 50 is rotated so that the fixing projection 73 moves from the first positioning portion 61 to the second positioning portion 62. Then, the developer having been attached on the developing sleeve 41 of the developer carrier 40 during the printing process is removed and is collected into the developer-storing portion 7, and the developer being stored in the developer-storing portion 7 is not leaked outside of the developing apparatus 1.

Hereinafter, a method to prevent developer from flowing out from the developing apparatus 1 according to an exemplary embodiment of the present general inventive concept will be explained with reference to FIGS. 1, 3 and 12.

Figure 12:
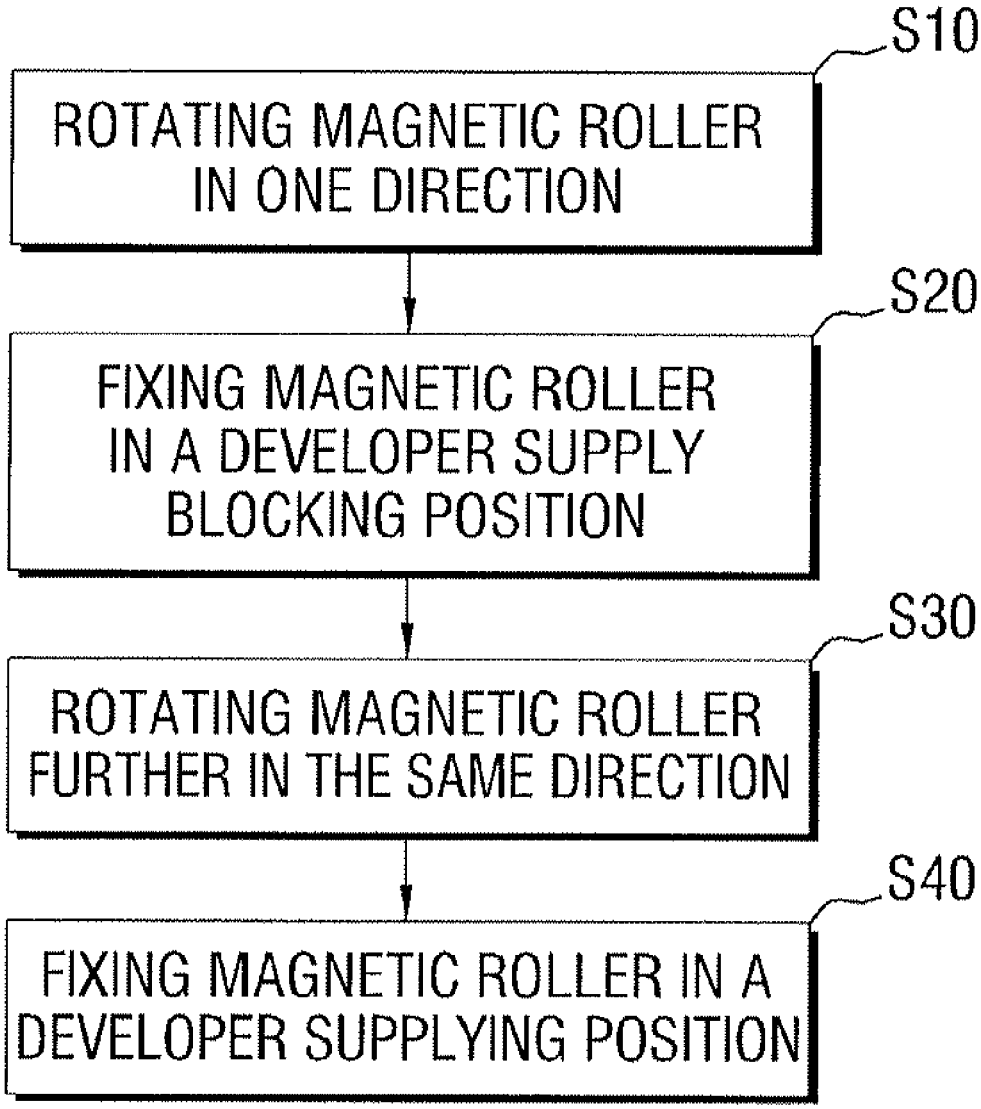
FIG. 12 is a flow chart illustrating a method to prevent developer from flowing out from a developing apparatus according to an exemplary embodiment of the present general inventive concept.

FIG. 12 is a flow chart illustrating a method to prevent developer from flowing out the developing apparatus 1 according to an exemplary embodiment of the present general inventive concept.

The method to prevent developer from flowing out according to this exemplary embodiment may be used in the developing apparatus 1 including the developer carrier 40 having the developing sleeve 41 and the magnetic roller 42 that is disposed inside the developing sleeve 41 and has the plurality of magnetic poles S1, N1, S2, N2, and N3. The method to prevent developer from flowing out according to this exemplary embodiment may include an operation of rotating the magnetic roller 42 in one direction, and an operation of fixing the magnetic roller 42 in the developer supply blocking position in which the plurality of magnetic poles S1, N1, S2, N2, and N3 of the magnetic roller 42 is arranged to prevent developer from being moved by the developing sleeve 41.

At this time, the magnetic roller 42 can be rotated by the magnetic pole rotating member 70 of the magnetic pole changing apparatus 50. When the fixing projection 73 of the magnetic pole rotating member 70 is disposed at the second positioning portion 62, the plurality of magnetic poles S1, N1, S2, N2, and N3 of the magnetic roller 42 is arranged at the developer supply blocking position. Therefore, the developer in the developer-storing portion 7 is not leaked outside of the developing apparatus 1.

Also, the method to prevent developer from flowing out according to this exemplary embodiment may include an operation of rotating the magnetic roller 42 further in the same direction, and an operation of fixing the magnetic roller 42 in the developer supplying position in which the plurality of magnetic poles S1, N1, S2, N2, and N3 of the magnetic roller 42 is arranged for the developing sleeve 41 to convey developer.

At this time, the magnetic pole rotating member 70 of the magnetic pole changing apparatus 50 is rotated for the fixing projection 73 of the magnetic pole rotating member 70 to move from the second positioning portion 62 to the first positioning portion 61 so that the plurality of magnetic poles S1, N1, S2, N2, and N3 of the magnetic roller 42 is arranged at the developer supplying position. Therefore, a normal printing operation is possible.

With the developing apparatus usable with an image forming apparatus according to an exemplary embodiment of the present general inventive concept, the image forming apparatus having the same, and the method to prevent developer from flowing out the developing apparatus, the developer attached on the surface of the developer carrier during a performance test prior to shipping can be easily removed from the developer carrier. Therefore, developer can be prevented from being leaked from the developing apparatus during transportation.

Also, with the developing apparatus usable with an image forming apparatus according to an exemplary embodiment of the present general inventive concept, the image forming apparatus having the same, and the method to prevent developer from flowing out the developing apparatus, because developer being stored in the developing apparatus is not leaked from the developing apparatus, transporting the developing apparatus is inconvenient.

Also, with the developing apparatus usable with an image forming apparatus according to an exemplary embodiment of the present general inventive concept, the image forming apparatus having the same, and the method to prevent developer from flowing out the developing apparatus, by only rotating the magnetic roller of the developer carrier by a determined angle to change an arrangement of the plurality of magnetic poles, developer can be prevented from flowing out the developing apparatus. Therefore, an operation to prevent developer from leaking from the developing apparatus is simple.

Also, with the developing apparatus usable with an image forming apparatus according to an exemplary embodiment of the present general inventive concept, the image forming apparatus having the same, and the method to prevent developer from flowing out the developing apparatus, because the magnetic roller of the developer carrier is used to prevent developer from flow out from the developing apparatus, using separate sealing members and/or packing members to prevent developer from leaking is not required. Therefore, packing costs of the developing apparatus may be reduced.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing apparatus usable with an image forming apparatus, the developing apparatus comprising:

a developer carrier including a magnetic roller having a plurality of magnetic poles and configured to convey developer to an image carrier;

a case to rotatably support the developer carrier, and to store developer being supplied to the developer carrier; and a magnetic pole changing apparatus disposed at an end of the developer carrier to change a position of the magnetic roller to change a position of the plurality of magnetic poles with respect to the case so that the plurality of magnetic poles is arranged in one of a developer supplying position in which the developer carrier conveys the developer to the image carrier and a developer supply blocking position in which the developer carrier does not convey the developer to the image carrier.

2. The developing apparatus of claim 1, wherein the developer carrier comprises:

a developing sleeve rotatably disposed at the case.

3. The developing apparatus of claim 2, wherein the magnetic pole changing apparatus comprises:

a magnetic pole positioning member disposed at the case, the magnetic pole positioning member having a plurality of positioning portions; and a magnetic pole rotating member disposed at an end of a shaft of the magnetic roller to allow the magnetic roller to be fixed in any one of the plurality of positioning portions of the magnetic pole positioning member.

4. The developing apparatus of claim 3, wherein the magnetic pole rotating member comprises:

a rotating plate disposed at the shaft of the magnetic roller; and at least one fixing projection disposed at the rotating plate.

5. The developing apparatus of claim 4, wherein the magnetic pole rotating member further comprises:

at least one elastic strip on which the at least one fixing projection is disposed.

6. The developing apparatus of claim 4, wherein the magnetic pole rotating member further comprises:

a handle.

7. The developing apparatus of claim 3, wherein the magnetic pole rotating member comprises:

a lever perpendicularly disposed at an end of the shaft of the magnetic roller; and a fixing projection disposed at a leading end of the lever.

8. The developing apparatus of claim 3, wherein the magnetic pole changing apparatus allows the magnetic roller to rotate only in one direction.

9. The developing apparatus of claim 8, wherein the magnetic pole positioning member is formed in a ratchet.

10. The developing apparatus of claim 2, further comprising:

a developing sleeve driving member disposed at a first side of the case to drive the developing sleeve.

11. The developing apparatus of claim 10, wherein the magnetic pole changing apparatus is disposed at a second sidewall of the case opposite to the first sidewall of the case at which the developing sleeve driving member is disposed.

12. The developing apparatus of claim 1, wherein the plurality of magnetic poles comprises:

a developing pole;

a conveying pole;

a separating pole; and an attracting pole arranged in a circumference.

13. The developing apparatus of claim 12, further comprising:

a developer-regulating member to regulate a height of the developer attached on the developer carrier, wherein when the magnetic pole changing apparatus is set so that the attracting pole of the plurality of magnetic poles faces the developer-regulating member, the developer carrier conveys the developer.

14. The developing apparatus of claim 13, wherein when the magnetic pole changing apparatus is set so that the separating pole of the plurality of magnetic poles faces the developer-regulating member, the developer carrier does not convey the developer.

15. The developing apparatus of claim 1, further comprising:

an image carrier rotatably disposed at the case parallel to the developer carrier.

16. An image forming apparatus, comprising:

a printing medium feeding unit to feed a printing medium;

an image carrier on which electrostatic latent images corresponding to printing data are formed;

a developing apparatus to develop the electrostatic latent images formed on the image carrier into developer images, the developing apparatus comprising:

a developer carrier including a magnetic roller having a plurality of magnetic poles;

a case to rotatably support the developer carrier, and to store developer being supplied to the developer carrier; and a magnetic pole changing apparatus disposed at an end of the developer carrier to change a position of the magnetic roller to change a position of the plurality of magnetic poles with respect to the case so that the plurality of magnetic poles are arranged in one of a developer supplying position in which the developer carrier conveys the developer to the image carrier and a developer supply blocking position in which the developer carrier does not convey the developer to the image carrier.

17. A method to prevent developer from flowing out from a developing apparatus having a developing sleeve and a magnetic roller disposed inside the developing sleeve and having a plurality of magnetic poles, the method comprising:

rotating the magnetic roller in one direction; and fixing the magnetic roller in a developer supply blocking position in which the plurality of magnetic poles of the magnetic roller is arranged to prevent developer from being moved by the developing sleeve.

18. The method of claim 17, further comprising:

rotating the magnetic roller further in a same direction; and fixing the magnetic roller in a developer supplying position in which the plurality of magnetic poles of the magnetic roller is arranged for the developing sleeve to convey developer.

19. The method of claim 17, wherein the magnetic roller rotates in a same direction as a rotating direction of the developing sleeve.

20. The method of claim 17, wherein the plurality of magnetic poles comprises:

a developing pole;

a conveying pole;

a separating pole; and an attracting pole arranged in a circumference, wherein when the attracting pole faces the image carrier and the developer is not conveyed to the image carrier by the developing sleeve.

21. The method of claim 20, wherein when the developing pole faces the image carrier, the developer is conveyed to the image carrier by the developing sleeve.

22. A developing apparatus usable with an image forming apparatus, the developer apparatus comprising:

a developer carrier;

a magnetic roller having a plurality of magnetic poles, and to rotate to arrange the plurality of magnetic poles in one of a developer supplying position in which the developer carrier conveys developer to an image carrier and a developer supply blocking position in which the developer carrier does not convey the developer to the image carrier: and a magnetic pole changing apparatus disposed at an end of the developer carrier and to fix the magnetic roller at one of the developer supplying position and the developer blocking position.

23. The developing apparatus of claim 22, wherein in the developer supply blocking position the developer is prevented from flowing out of the developing apparatus.

* * * * *